United States Patent [19]

Strain

[11] 4,258,511

[45] Mar. 31, 1981

[54] INDUSTRIAL NOISE ABATEMENT ENCLOSURE

[76] Inventor: William E. Strain, 13345 Merriman Rd., Livonia, Mich. 48519

[21] Appl. No.: 25,212

[22] Filed: Mar. 29, 1979

[51] Int. Cl.[3] ..... E04H 1/00

[52] U.S. Cl. ..... 52/79.1; 52/270; 52/406

[58] Field of Search ..... 52/270, 281, 283, 781, 52/805, 809, 829, 648, 79.1, 406

[56] References Cited

U.S. PATENT DOCUMENTS

| | | | |
|---|---|---|---|
| 3,537,219 | 11/1970 | Navarre | 52/489 X |
| 3,829,999 | 8/1974 | Bernstein | 52/648 X |
| 3,885,362 | 5/1975 | Pollock | 52/122 |
| 3,946,528 | 3/1976 | Jacobson et al. | 52/805 X |

FOREIGN PATENT DOCUMENTS

| | | | |
|---|---|---|---|
| 967324 | 5/1975 | Canada | 52/283 |

*Primary Examiner*—Price C. Faw, Jr.
*Assistant Examiner*—Carl D. Friedman
*Attorney, Agent, or Firm*—Cullen, Sloman, Cantor, Grauer, Scott & Rutherford

[57] ABSTRACT

An industrial noise abatement enclosure having opposed walls includes an open framework and a series of elongated acoustical panels arranged side by side and removably mounted upon the top and sides of the framework. The framework has corner posts with right angularly related connectors at their top and bottom. A plurality of pairs of vertically spaced top and bottom tubes have their ends snugly telescoped over the connectors. Coplanar spaced upturned and downturned channels are respectively mounted upon the bottom and top tubes. The panels at their ends are loosely interlocked with the channels and extend between the corner posts. The roof panels span and rest upon the top tubes. The panels are individually liftable within the channels and removable therefrom for easy access to the interior of the enclosure. Each panel is in the form of a box with a perforated inner wall. The panel faces have side flanges which are interconnected by side strips. Each strip mounts an elongated flexible bead for registry with the adjacent panel. A filler of a mineral material is nested within each panel.

14 Claims, 6 Drawing Figures

INDUSTRIAL NOISE ABATEMENT ENCLOSURE

BACKGROUND OF THE DISCLOSURE

Heretofore, in factories and plants involving machinery producing uncomfortable high levels of noise in their operation there has long been a problem as to the safety and comfort of workers. Industrial noise levels are particularly objectionable in the use of, without exclusion of other devices, 200-ton presses, wood fabricators, nut forming equipment, punches, and dies. In accordance with the Walsh Healey Act, as amended May 8, 1969, occupational noise standards for a person require that he may not work more than eight hours at a maximum of 90 dBA, as measured on the A scale of a sound level meter.

Efforts have been made in the provision of noise enclosure devices such as found in U.S. Pat. No. 3,885,362 entitled "Modular Noise Abatement Enclosure and Joint Seal". In that patent there is provided a noise abatement enclosure having a framework with a top rail and wherein a series of panels side by side are suspended therefrom as a sole support for the panels. The structure disclosed in that patent is complicated and involved as distinquished from the present invention, wherein there is provided a very simplified framework of a hollow tubular construction wherein a series of panels are arranged and supported on the framework so as to enclose the framework without the use of fasteners, providing for easy removability of panels as desired for access to the interior of the enclosure containing a machine, tool or other noisy machinery.

SUMMARY OF THE INVENTION

The present invention is directed to an industrial noise abatement enclosure which has opposed walls and which comprising an open tubular framework mountable upon a floor surface and incorporates a series of elongated acoustical panels of rectangular cross section which are arranged side by side in a sealing relationship and loosely and removably mounted upon the framework which defines the walls and roof of the enclosure.

The present framework is free standing and open and includes corner posts with right angularly related connectors at the top and bottom of each post, and with the connectors between an adjacent pair of posts being aligned laterally and longitudinally. The frame members are square in cross section.

A plurality of pairs of vertically spaced coplanar top and bottom tubes are provided with each pair or tubes defining a wall of the enclosure, and with respective ends of the tubes snugly and frictionally telescoped over said connectors, respectively for interlock with the corner posts.

Elongated upturned bottom channels are mounted upon and secured to each bottom tube along its length. Elongated downturned top channels are mounted on and secured to each top tube along its length, with the respective top and bottom channels being in alignment.

Panels span and at their ends are nested and removably interlocked with the top and bottom channels and extend between the corner posts for defining the walls of the enclosure. The panels which define the roof are arranged side by side and span and rest upon the top tubes of the framework. The respective panels which define the side walls rest upon the bottom channels with a suitable resilient gasket strip interposed and are of such height as to loosely extend within the top channels for retention thereby.

The panels which define the roof are arranged side by side in sealing relationship and are supported upon the top tubes of the framework. A resilient gasket strip is applied to the floor surface and underlies the bottom tubes of the framework. An additional gasket strip is mounted upon the top tubes for yieldably supporting the roof panels.

Each of the panels have one or more handles thereon whereby without the use of tools or fastening devices, the respective panels may be assembled with respect to the framework and likewise, are easily removable selectively to provide access to the interior of the enclosure.

Each of the respective panels have along opposite sides, a resilient flexible bead or sealing strip which projects laterally of the panels for cooperative sealing engagement with an adjacent panel.

Each of the panels includes inner and outer panel faces with inwardly directed side flanges having reversed turned locking edges. A pair of laterally spaced elongated assembly channel strips are positioned between the panel faces. Each of the strips have inwardly directed opposed locking edges, which define an elongated chamber and additionally are cooperatively interlocked with the flange lock edges upon opposite sides of the panel faces for securing the panel faces together. An elongated resilient gasket is nested within the chamber of each of the assembly channel strips and includes an elongated bead which projects outwardly of the strip along and outwardly of the sides of the panel. Each panel is filled with a filler of mineral or other foam material. The inner panel faces are perforated. Top and bottom channels overlie the ends of the respective panel faces completing the panel enclosure.

It is the primary object of the present invention to provide a simplified self standing open framework of a tubular construction and wherein the respective opposed pairs of top and bottom tubes at their ends are telescopically interlocked with adjacent corner posts. It a further object to provide a simplified noise abatement enclosure consisting of a plurality of acoustically isolating panels which are easily and removably mounted between opposed channels on the top and bottom tubes of the framework without the use of tools or fasteners.

These and other objects will be seen from the following specification and claims in conjunction with the appended drawings.

THE DRAWINGS

DETAILED DESCRIPTION OF AN EMBODIMENT OF THE INVENTION

It will be understood that the above drawings illustrate merely a preferred embodiment of the invention, and that other embodiments are contemplated within the scope of the claims hereafter set forth.

Figure 1:
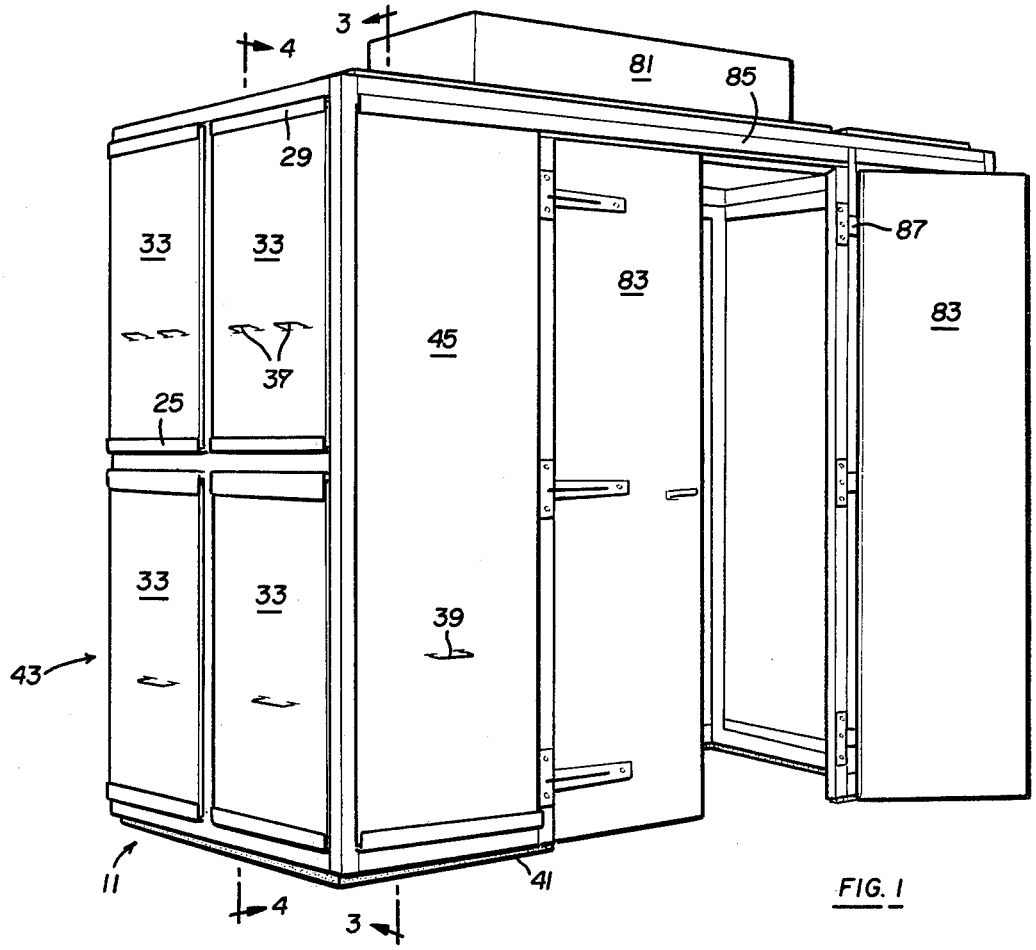
FIG. 1 is a perspective view of the present noise abatement enclosure.
Figure 2:
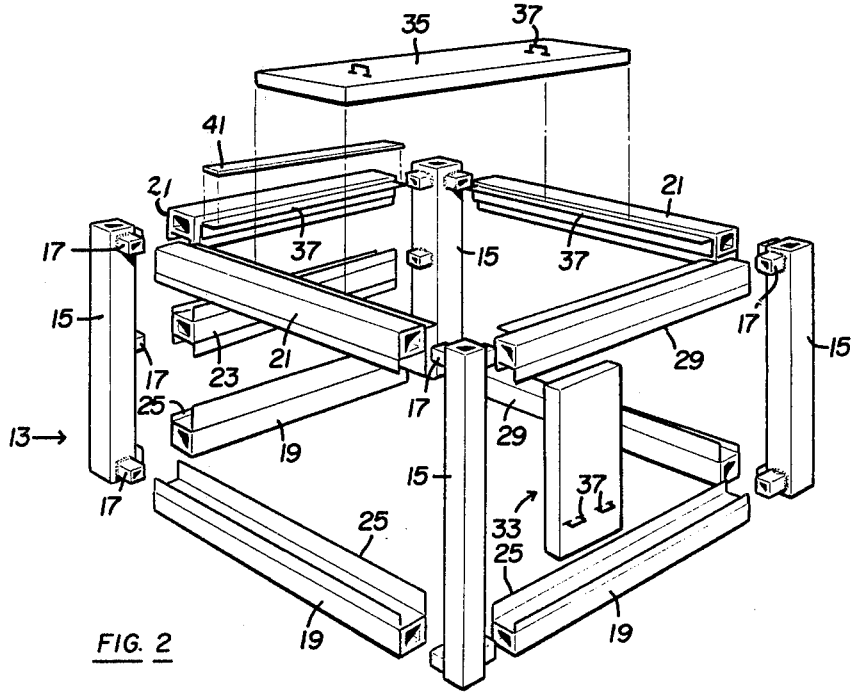
FIG. 2 is a perspective exploded view of the tubular framework therefore.
Figure 3:
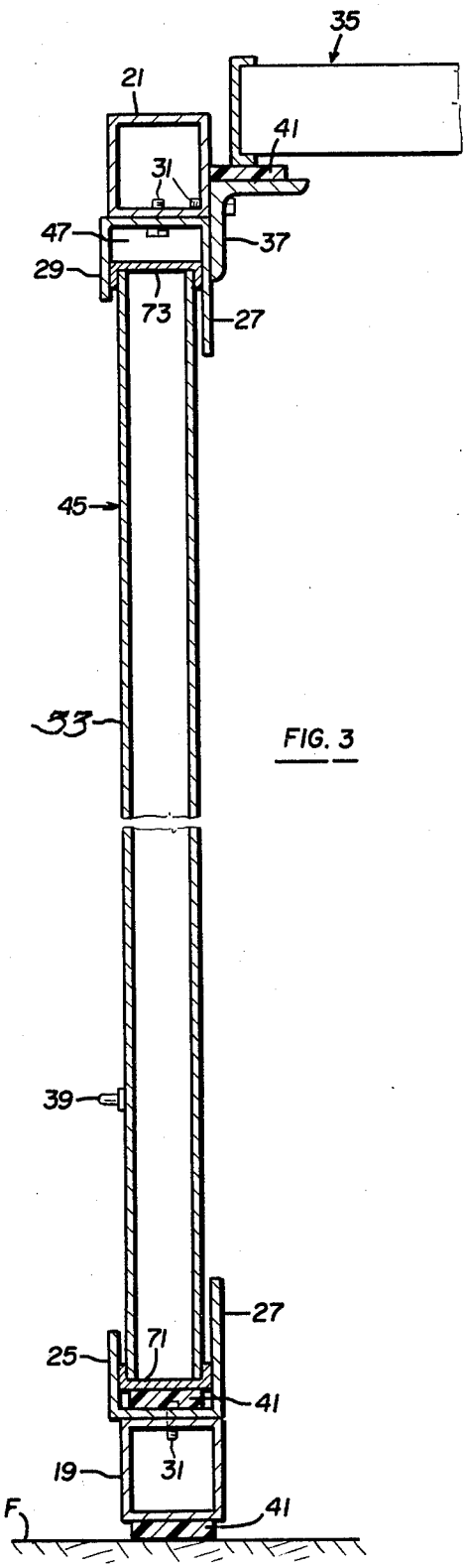
FIG. 3 is a vertical section of a one tier wall of the enclosure taking the direction of arrows 3—3 of FIG. 1.
Figure 4:
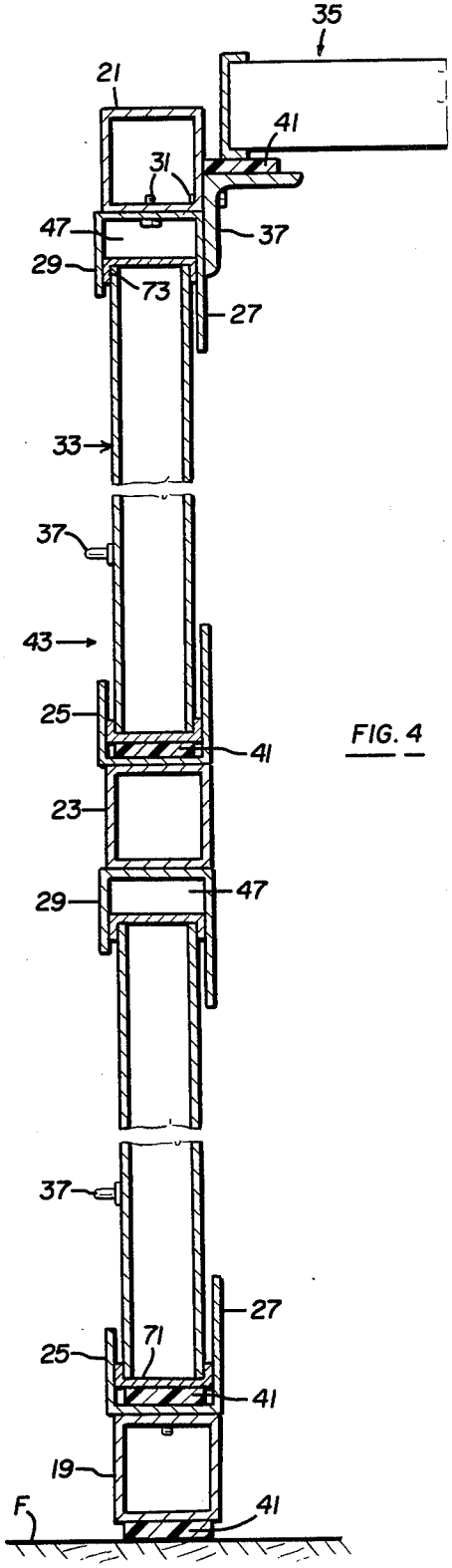
FIG. 4 is a fragmentary vertical section of a two-tier wall taken in the direction of arrows 4—4 of FIG. 1.

The present industrial noise abatement enclosure is generally illustrated at 11 in FIG. 1 as mounted upon a floor surface F, FIGS. 3 and 4 and including an open tubular free-standing framework 13 shown in FIG. 2.

The framework in the disclosed embodiment consists of a series of tubular components which are all assembled together without the requirement of fasteners, and include a plurality of upstanding corner posts 15. Right angularly related connectors 17 are mounted upon the top and bottom of each corner post, with the connectors between an adjacent pair of posts being aligned laterally and longitudinally respectively. Forming each side of the framework there is provided bottom telescoping tube 19 and top telescoping tube 21. The top and bottom tubes are arranged in a pair corresponding to each side of the enclosure with the respective ends of the tubes snugly telescoped over the respective connectors 17 for interlock with the corner posts. This provides a free-standing framework for the enclosure.

Since one of the walls 43 shown in FIG. 1 provides for two tiers of panels, one pair of corner posts shown in FIG. 2 have the inwardly directed additional tubular connectors 17 adapted to telescopically receive the respective ends of the intermediate tube 23, fragmentarily shown in FIG. 2 and described in further detail with respect to FIG. 4. The two tiers of panels are assembled with respect to the framework in the manner shown in FIG. 1 and FIG. 4.

An elongated bottom channel 25 having a base is mounted upon and along the top of each of the bottom tubes 19 and secured thereto by suitable fasteners 31, FIG. 3.

Top channels 29 facing downwardly and having a base are secured to the undersurface of each of the top tubes 21 by additional fasteners as shown at 31, FIG. 3. The respective sets of vertically spaced channels are coplanar and are adapted to supportably receive the plurality of acoustical panels 33 which are arranged side-by-side, supported and secured between respective top and bottom channels 25 and 25. Corresponding acoustical roof panels 35 are arranged side-by-side and span the respective top tubes and are supported thereon in the manner best shown in FIGS. 2, 3 and 4.

Upon the interior of each of the top tubes 21 and extending along the length thereof are the elongated angle plates 37. Said plates overlie inner wall portions of the top channels 29 and are secured to the top tubes as by the additional fasteners 31, FIG. 3.

Each of the respective panels 33 and 35 in the one tier wall 45 and in the two tier wall 43 as shown in FIGS. 1, 3 and 4 have one or more handles 39 adjacent one or both ends of a panel to facilitate assembly of the panels with respect to the supporting channels or for removal thereof as hereafter described.

The back plate 27 of the channels as in FIGS. 3 and 4 are of a greater height than the outer plate of said channels to more effectively support and retain the panels 33 with respect to said channels as best shown in FIG. 3.

The spacing of the channels 25 and 29 is such that with the respective top and bottom portions of each panel nested within said channels and resting upon the elongated resilient gasket 41 within the bottom channel there is provided a clearance space 47 within the top channel to facilitate assembly and disassembly of said panels. Each pair of channels defines a lateral opening of a predetermined height. Each panel is of a height greater than said lateral opening. The distance between the bases of a pair of such channels is greater than the height of each panel.

Accordingly, the respective panels span and at their ends are nested and removably interlocked within the top and bottom channels and as shown in FIG. 1 extend between the corner posts for completing the walls of the enclosure.

The clearance space 47 within the top channel permits the individual panel to be manually elevated into that space such sufficient distance as will provide a clearance of the bottom of the panel from the bottom channel and facilitate removal of said panel outwardly as designated by the arrow in FIG. 3. By this construction, the panels individually may be manually removed from the corresponding channels and reassembled thereto without the use of any tools.

All of the upright panels are supported upon bottom channel strips of a resilient gasket 41 constructed preferably of Neoprene, for example, or other resilient material.

The increased height of the back plates 27 of the individual channels prevents the panel from being displaced from the channels inwardly into the enclosure and limits their removal to positions outwardly of the enclosure.

In the construction of the wall referred to as a two tier wall 43 shown in FIGS. 1 and 4, there is applied the intermediate tube 23 whose ends are telescoped over the adjacent connectors 17 shown in FIG. 2 for interlock with the adjacent corner posts and providing the support for the corresponding two tiers of panels.

Along the top of the intermediate tube of the framework, there is mounted and secured an elongated upturned channel 25 corresponding to the bottom channels of FIGS. 3 and 4 which extends along the length of the intermediate tube and is suitable secured thereto by fasteners 31, as shown in FIG. 3.

Upon the undersurface of the intermediate tube 23 there is also secured a corresponding downturned top channel 29 similarly secured thereto along the undersurface thereof.

In this construction as shown in FIG. 4 for the two tier wall 43 also shown in FIG. 1, the lower tier of panels 33 are of less height than the panels 33 of FIG. 3 for the one tier wall 45. The respective panels 33 are arranged side-by-side in a row for the respective upper and lower tiers and are individually and manually assembled with respect to the opposed channels 25 and 29 above and below the intermediate tube 23 for completing the assembly of the two tier wall 43 of FIG. 4.

In each case there is mounted upon the base of the bottom channels 25 in FIG. 4 a strip of resilient gasket, such as a Neoprene gasket, which supportably underlies the lower ends of each of the respective panels 33. At the same time, the roof panels 35 which are arranged side-by-side are supportably and yieldably mounted upon corresponding gasket strips 41 which are mounted upon the angle flanges 37 arranged inwardly of the top tubes 21.

PANEL CONSTRUCTION

Figure 5:
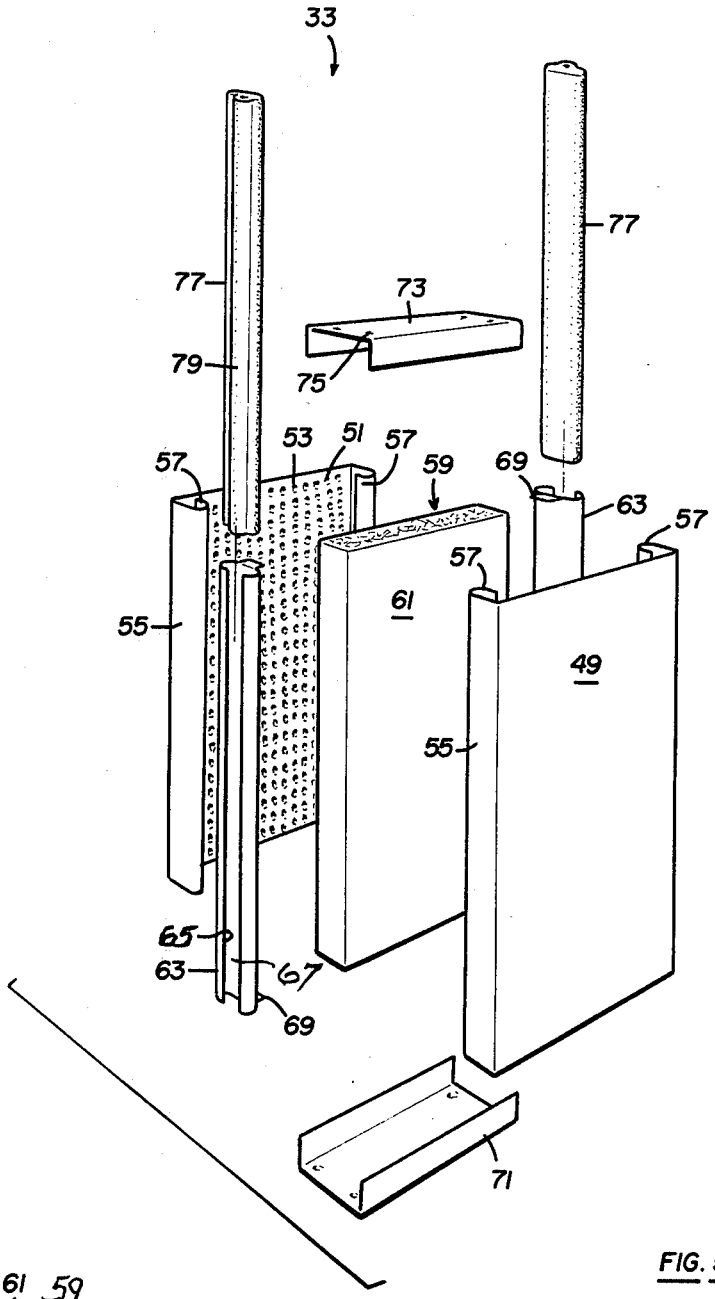
FIG. 5 is an exploded perspective view of the panel construction.
Figure 6:
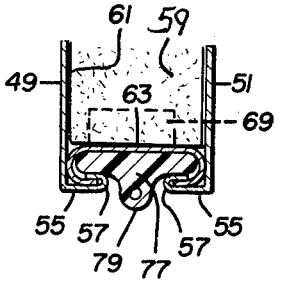
FIG. 6 is a fragmentary vertical section showing the panel assembly and mounting of the vertical sealing gasket.

The panels 33 and 35 are shown in the exploded perspective view FIG. 5 and in the fragmentary section FIG. 6.

The panels are normally provided in modular widths of 30 inches or 45 inches and include outer panel face 49 made of 18-gauge steel, for example, and the inner panel face 51 preferably constructed of a 20-gauge steel. Both panel faces have a hot dipped galvanized finish. The inner panel is perforated throughout at 53, FIG. 5, by a series of ⅛ inch diameter holes arranged at 7/32 inch staggered centers for illustration.

Each of the panel faces have inwardly directed side flanges 55 which terminate in reverse turned lock edges 57.

A suitable acoustical filler 59, rectangular in cross section, and which may be MYLAR wrapped or otherwise wrapped to prevent oil soaking, is nested between the respective inner and outer panel faces and retained therebetween.

The filler is preferably a relatively dense non-flammable mineral material and may be enclosed in a suitable plastic material as shown at 61 to prevent absorption of oil or other contaminants. A suitable filler would be a mineral fiber felt, preferably a fine mineral fiber, semi-rigid in composition, such as "Thermafiber" sold by U.S. Gypsum Company, having a density of six pounds per cubic foot. Other materials including fiberglass mats and foam may be used. The total panel thickness in the illustrative embodiment is 25/16 inches.

The elongated assembly channel strips 63 each include a reverse turned lock edge 65 defining elongated chamber 67 and terminate at their respective top and bottom in the inwardly directed assembly tab 69.

The respective assembly channel strips 63 are arranged inwardly of the side flanges 55 and are telescoped along the length of the side flanges so that the return lock edges 65 retainingly engage over and receive corresponding return lock edges 57 of the side flanges in the manner shown in FIG. 6.

When the assembly channel strips have been moved longitudinally so as to engage over the full length of the respective inner and outer panel faces, said faces are effectively secured together with the acoustical filler 59 interposed. As set forth above, said filler is a non-flammable mineral felt such as rock wool having a 6 pound density.

Within the chamber 67 formed along the length of the assembly channel strips 63 there is telescopically mounted and removably nested therein the elongated gasket 77 of a flexible material, such as neoprene, which is interposed between the back wall of the connector 63 and reverse turned edges 57 of the side flanges of the inner and outer panel faces.

The gasket is formed with an elongated sealing bead 79 which projects outwardly of the channel strip 63 along its length and in the assembled relationship projects laterally of the individual panel along its length and upon opposite sides thereof.

Accordingly in the assembly of the respective panels side-by-side there is a sealing relationship established between adjacent panels throughout their height or length, as in top panels 35.

The panel 33, or 35 for the roof construction, is completed by bottom channel 71 and the top or hanger channel 73 which overlies the respective end portions of the inner and outer panel faces. These bear against the respective tabs 69 and are secured thereto by a series of fasteners employing the fastener apertures 75 shown in FIG. 5 at the ends of the respective channels 71 and 73. Therefore, each of the respective panels is provided upon opposite sides thereof along the length thereof with a flexible neoprene or other resilient gasket for the central portion of each such panel to thereby assure a seal between adjacent panels.

Without being described in detail, the enclosure is normally provided with a ventilating system designated at 81, FIG. 1, normally upon the top of the enclosure and which may include an air exhaust duct and an associated exhaust fan. Upon some other area of the enclosure such as upon the side or on the rear thereof there may be provided an additional air intake duct panel or the like by which atmospheric air may be introduced into the interior of said enclosure.

As shown in FIG. 1, there are provided a pair of opposed doors 83 of a construction similar to the panels above described but which are suitably reinforced, particularly at their edges for nesting within the door frame 85 forming a part of the framework and secured thereto by a series of hinges 87.

The door or doors thus provides additional access to the interior of the enclosure should it be necessary to move a vehicle or a large object into and out of such enclosure. The individual removable wall panels provide additional access to the interior of the enclosure by their selective removal of one or more thereof as desired and without the requirement for the use of any tools or fasteners or clips.

In order to achieve a successful reduction of industrial noise by means of an enclosure there must be provided a proper acoustical design of the respective components and the assembly thereof into a rigid type structure such as has been provided by the use of a series of modular acoustical panels and a simplified means of removably mounting the panels upon the framework in side-by-side sealing arrangement and for enclosing the walls and top of the framework.

The present enclosure which achieves successful noise reduction offers minimal interference with the use of the equipment or the machine enclosed and at the same time provides access to the interior of the enclosure which is quick and simple.

The present door construction briefly referred to is the same as the panel construction except that an interior frame is added for additional strength and rigidity and for hinge attachment. Various door types and sizes may be employed to meet access requirements such as single doors, double doors, bifold doors or sliding doors.

The present free-standing frame supports and contains the side panels, doors and roof panels. The framing members shown in FIG. 2 are fabricated from 12-gauge, 2½ inch square steel tubing with the interlocking joints provided for positive location and rigidity. The respective channels are attached to the square steel tubing and are adapted to hold the side panels in proper position without the use of additional attachment means such as bolts or clips. The panels are removed simply by lifting them out of the frame channels. The present tubular framing provides the structural rigidity and dimensional control necessary to an enclosure for sound attenuation and durability.

While the door may provide access for pedestrians and die trucks, additional access for repair, maintenance and service of the machinery enclosed within the enclosure is readily available by selective panel removal. This is achieved by lifting an individual panel and moving the bottom portion outwardly freeing the panel from the upper and lower retaining channels without the use of any tools.

Having described my invention, reference should now be had to the following claims.

I claim:

1. An industrial noise abatement enclosure having opposed walls comprising an open framework mountable upon a floor surface and a series of elongated acoustical panels of rectangular cross section arranged side by side loosely and removably mounted upon said framework defining the walls and roof of said enclosure;

said framework including a plurality of spaced upright corner posts;

a pair of right angularly related connectors at the top and bottom of each post, with the connectors between an adjacent pair of posts being aligned laterally and longitudinally respectively;

a plurality of pairs of vertically spaced coplaner top and bottom tubes, with one pair of tubes for each wall of said enclosure, with the respective ends of said tubes snugly telescoped over said connectors, respectively for interlock with said corner posts;

an elongated upturned bottom channel having a base mounted on and secured to each bottom tube along its length;

an elongated downturned top channel having a base mounted on and secured to each top tube along its length, with the top and bottom channels for each wall in alignment; said channels defining a lateral opening of a predetermined height;

said panels spanning and at their ends nested and removably interlocked with said top and bottom channels and extending between said corner posts;

the panels defining the roof being arranged side by side, spanning and resting upon said top tubes respectively;

the panels defining said side walls resting upon said bottom channels and being of a height greater than said lateral opening and less than the distance between the bases of said channels so as to loosely nest within the top channels;

each of said panels comprising opposed inner and outer panel faces with inwardly directed opposed side flanges;

said flanges having reversed turned locking edges;

a pair of spaced elongated assembly channel strips between said panel faces inwardly of said flanges;

each strip having inwardly directed opposed lock edges defining an elongated chamber and cooperatively interlocked with said flange lock edges on opposite sides of said panel faces, securing said panel faces together;

an elongated resilient gasket nested within the chamber of each of said assembly channel strips and including an elongated bead projecting outwardly of said strip and along and outwardly of the sides of each panel;

an elongated filler of a mineral material, rectangular in cross section and nested between said panel faces;

said panel face being perforated;

and top and bottom channels overlying the ends of said panel faces;

said wall panels being individually liftable within the corresponding top channel to facilitate outward removal of the lower ends of each panel from the corresponding bottom channel.

2. In the noise abatement enclosure of claim 1, a resilient gasket strip upon said floor surface underlying the bottom tubes of said framework;

and additional resilient gasket strips mounted within the bottom channels and upon said top tubes, yieldably supporting said wall and roof panels, respectively.

3. In the noise abatement enclosure of claim 2, an elongated flexible sealing strip mounted upon and extending along the sides of each panel for cooperative sealing engagement between the panels of said walls and roof.

4. In the noise abatement enclosure of claim 1, inwardly directed angle strips secured to the interior of each of said top tubes along the length thereof and below the tops of said tubes;

the roof panels spanning and bearing upon said angle strips.

5. In the noise abatement enclosure of claim 4, a resilient gasket strip mounted upon said angle strips supportably underlying said roof panels.

6. In the noise abatement enclosure of claim 1, a handle upon the exterior of said panels to facilitate individual lifting of a panel relative to its retaining channels and for disengaging and removing said panel therefrom.

7. In the industrial noise abatement enclosure of claim 1, an elongated flexible sealing strip mounted upon and extending along the sides of each panel for cooperative sealing engagement between the panels in said walls and roof.

8. In the noise abatement enclosure of claim 1, said channels having inner and outer walls, the inner wall of each channel being of a greater height than the outer wall for increased supporting engagement of said panels and for limiting said panels for outward removal therefrom.

9. In the noise abatement enclosure of claim 1, the upper ends of said panels being spaced from the top of said top channels defining a clearance space for lifting said panels therein and for disengaging said panels from the bottom channel.

10. In the industrial noise abatement enclosure of claim 1, inwardly directed tabs at opposite ends of said assembly strips;

said latter top and bottom channels bearing against and secured to said tabs.

11. In the industrial noise abatement enclosure of claim 1, one of said enclosure walls having two tiers of panels;

a pair of opposed spaced connecters extending from a pair of corner posts including said one wall, intermediate their ends;

an intermediate tube with its ends snugly telescoped over said latter connecters and extending between said latter posts;

an elongated upturned bottom channel mounted on and secured to said intermediate tube along its length;

an elongated downturned top channel mounted on and secured to and depending from said intermediate tube along its length;

the panels of the lower tier being arranged side by side and interposed between the channels of said bottom tube and intermediate tube, and the panels of the upper tier being arranged side by side and interposed between the channels of said top tube and intermediate tube.

12. An industrial noise abatement enclosure having opposed walls comprising an open framework mountable upon a floor surface and a series of elongated acoustical panels of rectangular cross section arranged side by side loosely and removably mounted upon said framework defining the walls and roof of said enclosure;

said framework including a plurality of spaced upright corner posts;

a pair of right angularly related connectors at the top and bottom of each post, with the connectors between an adjacent pair of posts being aligned laterally and longitudinally respectively;

a plurality of pairs of vertically spaced coplaner top and bottom tubes, with one pair of tubes for each wall of said enclosure, with the respective ends of said tubes snugly telescoped over said connectors, respectively for interlock with said corner posts;

an elongated upturned bottom channel having a base mounted on and secured to each top tube along its length, with the top and bottom channels for each wall in alignment; said channels defining a lateral opening of a predetermined height;

said panels spanning and at their ends nested and removably interlocked with said top and bottom channels and extending between said corner posts;

the panels defining the roof being arranged side by side, spanning and resting upon said top tubes respectively;

the panels defining said side walls resting upon said bottom channels and being of a height greater than said lateral opening and less than the distance between the bases of said channels so as to loosely nest within the top channels;

each of said panels comprising opposed inner and outer panel faces with inwardly directed opposed side flanges;

said flanges having reversed turned locking edges;

a pair of spaced elongated assembly channel strips between said panel faces inwardly of said flanges;

each strip having inwardly directed opposed lock edges defining an elongated chamber and cooperatively interlocked with said flange lock edges on opposite sides of said panel faces, securing said panel faces together;

an elongated resilient gasket nested within the chamber of each of said assembly channel strips and including an elongated bead projecting outwardly of said strip and along and outwardly of the sides of each panel;

an elongated filler of a mineral material, rectangular in cross section and nested between said panel faces;

said inner panel face being perforated;

and top and bottom channels overlying the ends of said panel faces;

said wall panels being individually liftable within the corresponding top channel to facilitate outward removal of the lower ends of each panel from the corresponding bottom channel;

a resilient gasket strip upon said floor surface underlying the bottom tubes of said framework;

and additional resilient gasket strips mounted within the bottom channels, yieldably supporting said wall panels;

inwardly directed angle strips secured to the interior of each of said top tubes along the length thereof and below the tops of said tubes;

a resilient gasket strip mounted upon said angle strips supportably underlying said roof panels.

13. In the noise abatement enclosure of claim 12, a handle upon the exterior of said panels to facilitate individual lifting of a panel relative to its retaining channels and for disengaging and removing said panel therefrom.

14. In the industrial noise abatement enclosure of claim 12, an elongated flexible sealing strip mounted upon and extending along the sides of each panel for cooperative sealing engagement between the panels in said walls and roof.

* * * * *